US010307892B1

(12) United States Patent
Schaefer et al.

(10) Patent No.: US 10,307,892 B1
(45) Date of Patent: Jun. 4, 2019

(54) PIPE CLAMP ROTATION KIT

(71) Applicants: Paul B. Schaefer, Lebanon, OH (US); Robert L. Aldredge, Jr., Dayton, OH (US)

(72) Inventors: Paul B. Schaefer, Lebanon, OH (US); Robert L. Aldredge, Jr., Dayton, OH (US)

( * ) Notice: Subject to any disclaimer, the term of this patent is extended or adjusted under 35 U.S.C. 154(b) by 0 days.

(21) Appl. No.: 15/094,622

(22) Filed: Apr. 8, 2016

(51) Int. Cl.
*B25B 1/22* (2006.01)
*B25B 1/24* (2006.01)
*B25B 1/10* (2006.01)

(52) U.S. Cl.
CPC ..... *B25B 1/22* (2013.01); *B25B 1/103* (2013.01); *B25B 1/2484* (2013.01)

(58) Field of Classification Search
CPC ..... B25B 1/22; B25B 1/103; B25B 1/2484
USPC ..... 269/166, 170, 76, 167, 168, 169
See application file for complete search history.

(56) References Cited

U.S. PATENT DOCUMENTS 2,371,685 A * 3/1945 Flanders ..... B24B 19/022 451/222
2,786,372 A * 3/1957 Lassy ..... B25B 1/12 269/203
4,132,397 A 1/1979 Ward
5,349,979 A * 9/1994 Zeien ..... B25B 5/068 137/318
8,888,084 B1 * 11/2014 Aldredge ..... B25B 1/103 269/166

FOREIGN PATENT DOCUMENTS

WO WO 8911950 A1 * 12/1989 ..... B25B 1/103

* cited by examiner

*Primary Examiner* — Monica S Carter
*Assistant Examiner* — Katina N. Henson
(74) *Attorney, Agent, or Firm* — Donald J. Ersler

(57) ABSTRACT

A pipe clamp rotation kit preferably includes an adjustment end bracket, a pipe end bracket, an adjustment end collar, a pipe end collar and a tightening member. The adjustment end bracket includes a L-shaped bracket and a support pin. The support pin is sized to be received by an inner diameter of a support pipe of a pipe clamp. The pipe end bracket includes a pipe mounting plate and a pipe support plate. A pipe hole is formed through the pipe support plate to receive the support pipe of the pipe clamp. The adjustment end collar includes a collar base and a pair of ears. The support pipe is inserted through a bore in the collar base. A space between the pair of ears is sized to receive a lead screw of the pipe clamp. A threaded stud of the tightening member is threaded into the adjustment end collar.

18 Claims, 3 Drawing Sheets

PIPE CLAMP ROTATION KIT

BACKGROUND OF THE INVENTION

1. Field of the Invention

The present invention relates generally to tools and more specifically to a pipe clamp rotation kit, which allows an existing pipe clamp to be rotated and secured at some angularly orientation relative to a support surface.

2. Discussion of the Prior Art

U.S. Pat. No. 4,132,397 to Ward discloses a mounting bracket for a pipe clamp. However, the Ward patent requires at least one hand tool to change an angle of the pipe clamp. U.S. Pat. No. 8,888,084 to Aldredge et al. discloses a saw horse pipe clamp. However, Aldredge et al. cannot be used to modify an existing pipe clamp.

Accordingly, there is a clearly felt need in the art for a pipe clamp rotation kit, which allows an existing pipe clamp to be rotated and secured at some angularly orientation relative to a support surface, and which does not require hand tools to adjust the angular orientation of the clamp jaws relative to the support surface.

SUMMARY OF THE INVENTION

The present invention provides a pipe clamp rotation kit, which does not require hand tools to adjust an angular orientation of the clamp jaws relative to a support surface. The pipe clamp rotation kit preferably includes an adjustment end bracket, a pipe end bracket, an adjustment end collar, a pipe end collar and a tightening member. The tightening member preferably includes a handle and a threaded stud. The threaded stud extends from the handle. The adjustment end bracket includes a L-shaped bracket and a support pin. The L-shaped bracket includes a mounting plate and a support plate. The support plate extends upward from an edge of the mounting plate. At least two fastener holes are formed through the mounting plate to receive at least two fasteners. The support pin includes a pipe diameter on one end and a screw groove formed in an opposing end. The pipe diameter is sized to be received by an inner diameter of a support pipe of a pipe clamp. The screw groove is sized to receive an end of the threaded stud of the tightening member. The support pin is retained in a hole in the support plate. The pipe end bracket includes a pipe mounting plate and a pipe support plate. The pipe support plate extends upward from an edge of the mounting plate. At least two fastener holes are formed through the pipe mounting plate to receive at least two fasteners. A pipe hole is preferably formed through the pipe support plate to receive an outer diameter of the support pipe of the pipe clamp, but a support pin could also be used.

The adjustment end collar includes a collar base and a pair of ears. The pair of ears extend outward from an outer perimeter of the collar base. An adjustment screw bore is formed through the collar base to receive clamp the support pin. At least one end thread is formed through the adjustment end collar; perpendicular to an axis of the adjustment screw bore to threadably receive the threaded stud of the tightening member. A space between the pair of ears is sized to rotatably receive a lead screw of the pipe clamp. The end collar includes an inner diameter, which is sized to receive an outer diameter of the support pipe. A female thread is formed through the collar, perpendicular to an axis of the inner diameter. A fastener, such as a set-screw is threaded into the female thread to axially secure the end collar to the support pipe.

In use, the mounting plate of the adjustment end bracket is attached to a support surface with at least two fasteners. The support pin is inserted into the inner diameter of the support pipe at an adjustment end of the pipe clamp. The end collar is slipped over the non-adjustment end of the support pipe. The non-adjustment end of the support pipe is then inserted through the pipe hole in the pipe end bracket. The mounting plate of the pipe end bracket is secured to the support surface with at least two fasteners. The adjustment end collar is slipped over the adjustment end of the pipe clamp. The set screw is tightened in the end thread of the end collar against the support pipe. The pipe clamp is rotated, turned or pivoted with a first hand to a desired angular position and the tightening member is finally tightened with a second hand.

Accordingly, it is an object of the present invention to provide a pipe clamp rotation kit, which allows an existing pipe clamp to be rotated and secured at some angularly orientation relative to a support surface.

Finally, it is another object of the present invention to provide a pipe clamp rotation kit, which does not require hand tools to adjust an angular orientation of the clamp jaws relative to the support surface.

These and additional objects, advantages, features and benefits of the present invention will become apparent from the following specification.

DETAILED DESCRIPTION OF THE PREFERRED EMBODIMENTS

Figure 1B:
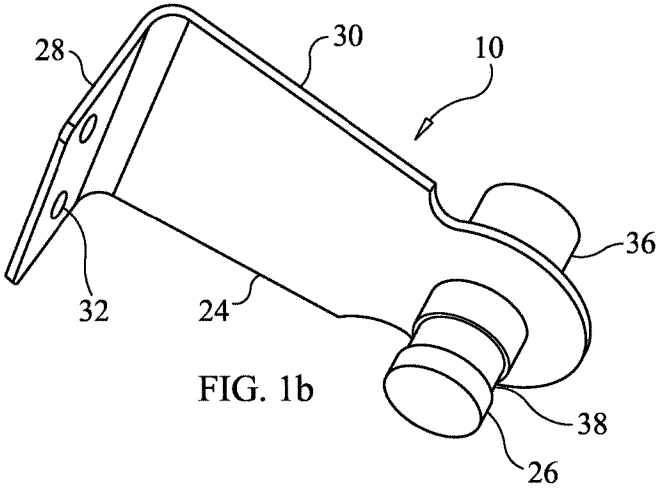
FIG. 1*b* is a perspective view of an adjustment end bracket of a pipe clamp rotation kit in accordance with the present invention.
Figure 1A:
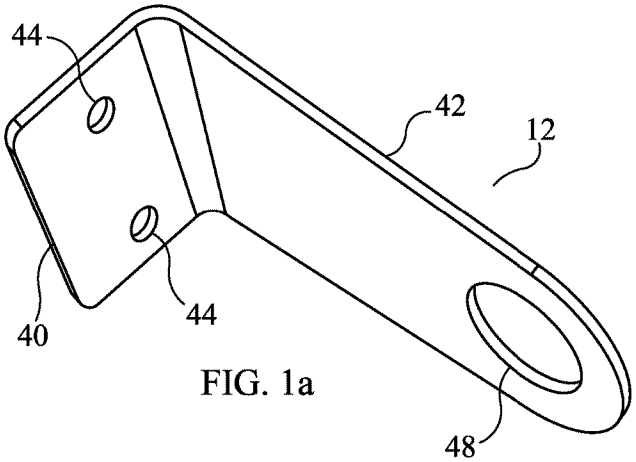
FIG. 1*a* is a perspective view of a pipe end bracket of a pipe clamp rotation kit in accordance with the present invention.
Figure 1E:
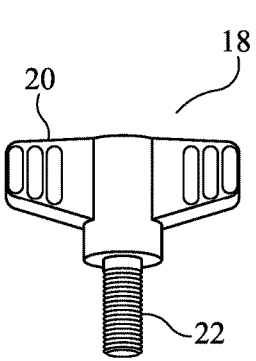
FIG. 1*e* is a perspective view of a tightening member of a pipe clamp rotation kit in accordance with the present invention.
Figure 1D:
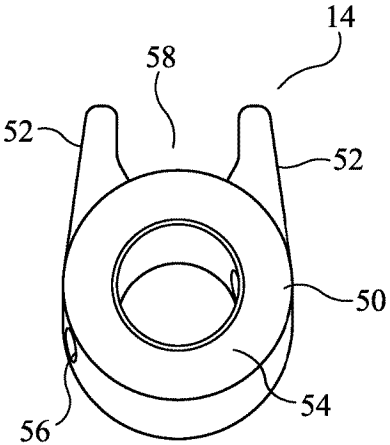
FIG. 1*d* is a perspective view of an adjustment end collar of a pipe clamp rotation kit in accordance with the present invention.
Figure 1C:
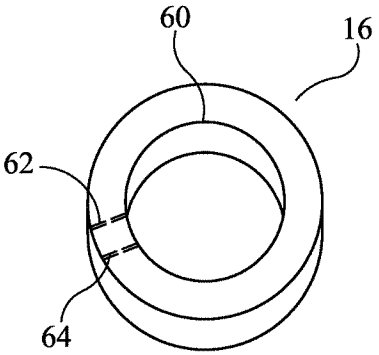
FIG. 1*c* is a perspective view of a pipe end collar of a pipe clamp rotation kit in accordance with the present invention.
Figure 2:
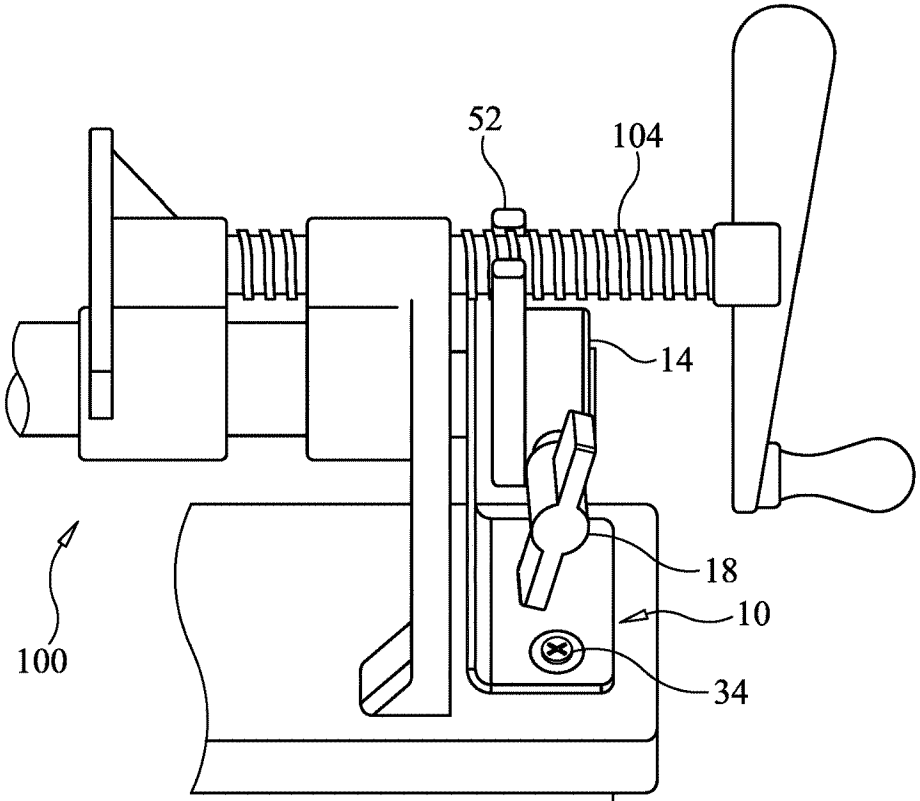
FIG. 2 is a perspective view of an adjustment end of a pipe clamp supported by an adjustment end bracket and with an adjustment end collar attached to a support pipe of the pipe clamp of a pipe clamp rotation kit in accordance with the present invention.

With reference now to the drawings, and particularly to FIGS. 1*a*-1*e*, there is shown an exploded perspective view of all the components of a pipe clamp rotation kit 1. The pipe clamp rotation kit 1 preferably includes an adjustment end bracket 10, a pipe end bracket 12, an adjustment end collar 14, a pipe end collar 16 and a tightening member 18. The tightening member 18 preferably includes a handle 20 and a threaded stud 22. The threaded stud 22 extends from the handle 20. The adjustment end bracket 10 includes a L-shaped bracket 24 and a support pin 26. The L-shaped bracket 24 includes a mounting plate 28 and a support plate 30. The support plate 30 extends upward from an edge of the mounting plate 28. With reference to FIGS. 1*b* and 2, at least two fastener holes 32 are formed through the mounting plate 28 to receive at least two fasteners 34. The support pin 26 includes a pipe diameter 36 on one end and a screw groove 38 formed in an opposing end.

Figure 4:
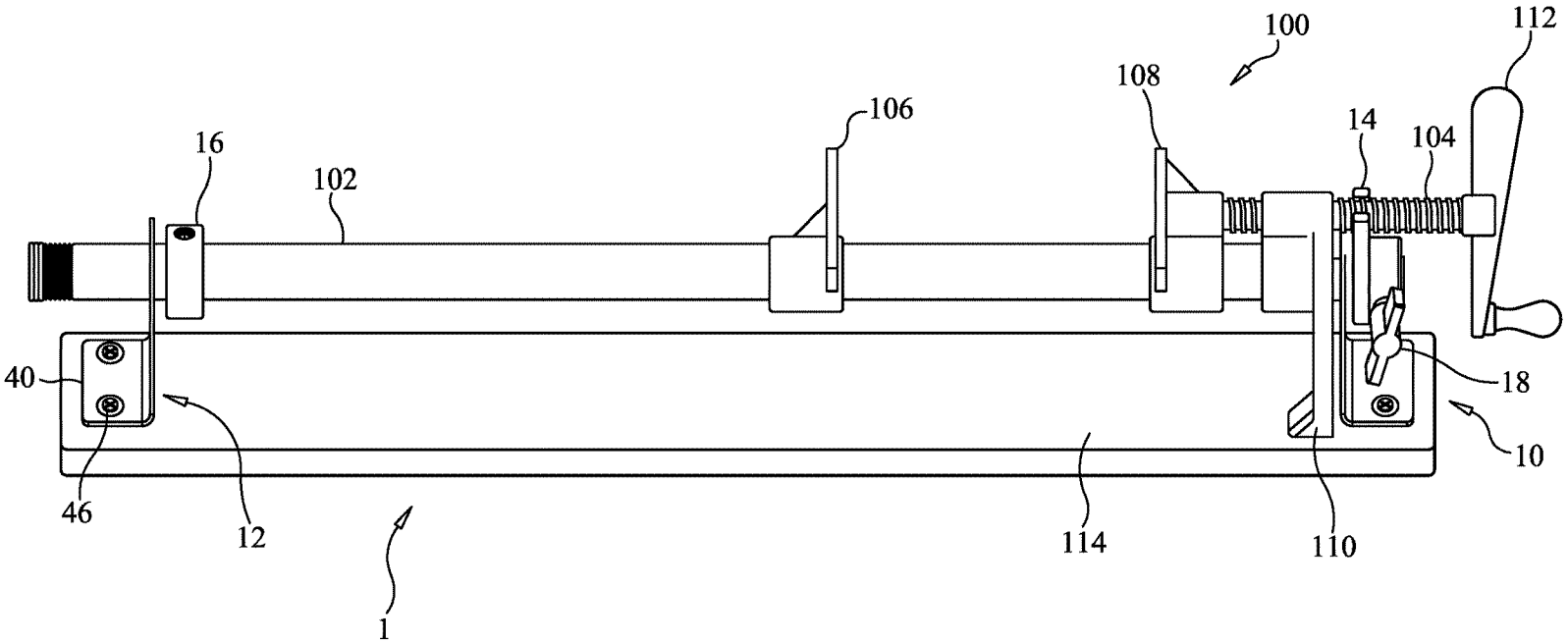
FIG. 4 is a perspective view of a pipe clamp supported by a pipe clamp rotation kit in accordance with the present invention.

With reference to FIG. 4, a pipe clamp 100 includes a support pipe 102, a lead screw 104, a slidable clamp jaw 106, an adjustable clamp jaw 108, a screw base 110 and a crank 112. The slidable clamp jaw 106 is retained on the support pipe 102. One end of the support pipe 102 is retained in the screw base 110. The lead screw 104 is threadably engaged with the screw base 110. One end of lead screw 104 is rotatably retained in the adjustable clamp jaw 108 and the crank 112 is attached to an opposing end of the lead screw 104. The pipe diameter 36 of the support pin 26 is sized to be received by an inner diameter of a support pipe 102 of a pipe clamp 100. The screw groove 38 is sized to receive an end of the threaded stud 22 of the tightening member 18. The support pin 26 is preferably retained in a hole in the support plate 30 with welding or any other suitable process. The support pin 26 does not rotate relative to the adjustment end bracket 10.

Figure 3:
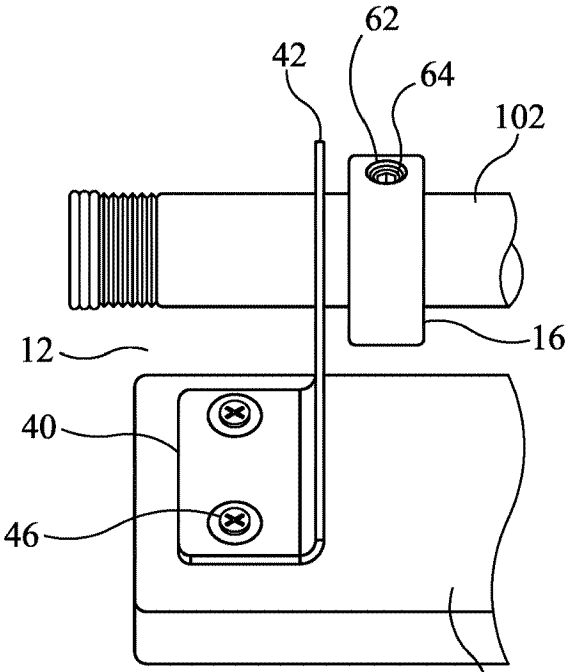
FIG. 3 is a perspective view of a non-adjustment end of a pipe clamp supported by a pipe end bracket and with an end collar attached to a support pipe of the pipe clamp of a pipe clamp rotation kit in accordance with the present invention.

With reference to FIG. 3, the pipe end bracket 12 includes a pipe mounting plate 40 and a pipe support plate 42. The pipe support plate 42 extends upward from an edge of the mounting plate 40. At least two fastener holes 44 are formed through the pipe mounting plate 40 to receive at least two fasteners 46. A pipe hole 48 is formed through the pipe support plate 42 to receive an outer diameter of the support pipe 102 of the pipe clamp 100. The adjustment end collar 14 includes a collar base 50 and a pair of ears 52. The pair of ears 52 extend outward from an outer perimeter of the collar base 50. An adjustment screw bore 54 is formed through the collar base 50 to receive the support pin 26. At least one end female thread 56 is formed through the adjustment end collar 50, perpendicular to an axis of the adjustment screw bore 54 to threadably receive the threaded stud 22 of the tightening member 18. A space 58 between the pair of ears 52 is sized to rotatably receive a lead screw 104 of the pipe clamp 100. The end collar 16 includes an inner diameter 60, which is sized to receive an outer diameter of the support pipe 102. A female thread 62 is formed through the end collar 16, perpendicular to an axis of the inner diameter 60.

In use, the mounting plate 28 of the adjustment end bracket 10 is attached to a support surface 114 with the at least two fasteners 34. The support pin 26 is inserted into the inner diameter of the support pipe 102 at an adjustment end of the pipe clamp 100. The end collar 16 is slipped over the non-adjustment end of the support pipe 102. The non-adjustment end of the support pipe 102 is then inserted through the pipe hole 48 in the pipe end bracket 12. The mounting plate 40 of the pipe end bracket 12 is secured to the support surface 114 with the at least two fasteners 46. The adjustment end collar 14 is slipped over the adjustment end of the support pipe 102. A fastener, such as a set screw 64 is tightened in the end thread 62 of the end collar 16 against the support pipe 102. The pipe clamp 100 is rotated, turned or pivoted by a first hand to a desired angular position and the tightening member 18 is finally tightened to angularly secure the pipe clamp 100 relative to the support surface 114 with a second hand. The support pipe 102 is capable of being rotated relative to the pipe end bracket 12 and the support pin 26. The adjustment end collar 14 is secured to the support pin 26 with the tightening member 18 to prevent rotation of the pipe clamp 100 relative to the pipe end bracket 12 and the adjustment end bracket 10.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A pipe clamp rotation kit for a pipe clamp, the pipe clamp includes a support pipe, a lead screw, a slidable clamp jaw, an adjustable clamp jaw, a screw base and a crank, the lead screw is threadably engaged with the screw base, an end of the lead screw is rotatably retained on an end of the adjustable clamp jaw, the adjustable clamp jaw is slidably retained on the support pipe, the crank rotates an opposing end of the lead screw, comprising:

an adjustment end bracket includes a L-shaped bracket and a support pin, said support pin extends from said L-shaped bracket, wherein an outer diameter of said support pin is inserted into an inner diameter of one end of the support pipe of the pipe clamp, said outer diameter of said support pin makes direct contact with the inner diameter of the support pipe;

a pipe end bracket includes a pipe hole, an opposing end of the support pipe is inserted through said pipe hole;

a tightening member includes a threaded stud; and an adjustment end collar includes a collar base and a pair of ears, said pair of ears extend from one side of said collar base, said pair of ears are adjacent to each other, a bore is formed through said collar base for insertion of said support pin, a space between said pair of ears is sized to capture opposing sides of the lead screw of the pipe clamp, the lead screw is capable of rotating relative to said pair of ears, said collar base includes a threaded hole, said threaded hole is sized to threadably receive said threaded stud, wherein the support pipe is capable of being rotated relative to said pipe end bracket and said support pin, said adjustment end collar is secured to said support pin with said tightening member to prevent rotation of the pipe clamp relative to said adjustment end bracket.

2. The pipe clamp rotation kit for a pipe clamp of claim 1, wherein:

said L-shaped bracket includes a mounting plate and a support plate, said support plate extends upward from said mounting plate.

3. The pipe clamp rotation kit for a pipe clamp of claim 2, wherein:

said support pin extends from opposing sides of said support plate.

4. The pipe clamp rotation kit for a pipe clamp of claim 1, wherein:

a screw groove is formed in said support pin, said screw groove is sized to receive an end of said threaded stud.

5. The pipe clamp rotation kit for a pipe clamp of claim 1, wherein:

said pipe end bracket includes a pipe mounting plate and a pipe support plate, said pipe support plate extends upward from said pipe mounting plate.

6. A pipe clamp rotation kit for a pipe clamp, the pipe clamp includes a support pipe, a lead screw, a slidable clamp jaw, an adjustable clamp jaw, a screw base and a crank, the lead screw is threadably engaged with the screw base, an end of the lead screw is rotatably retained on an end of the adjustable clamp jaw, the adjustable clamp jaw is slidably retained on the support pipe, the crank rotates an opposing end of the lead screw, comprising:

an adjustment end bracket includes a L-shaped bracket and a support pin, said support pin extends from said L-shaped bracket, wherein an outer diameter of said support pin is inserted into an inner diameter of one end of the support pipe of the pipe clamp, said outer diameter of said support pin makes direct contact with the inner diameter of the support pipe, said L-shaped bracket is attached to a support surface;

a pipe end bracket includes a pipe hole, an opposing end of the support pipe is inserted through said pipe hole, wherein said end bracket is attached to the support surface;

a tightening member includes a threaded stud; and an adjustment end collar includes a collar base and a pair of ears, said pair of ears extend from one side of said collar base, said pair of ears are adjacent to each other, a bore is formed through said collar base for insertion of said support pin, a space between said pair of ears is sized to capture opposing sides of the lead screw of the pipe clamp, the lead screw is capable of rotating relative to said pair of ears, said collar base includes a threaded hole, said threaded hole is sized to threadably receive said threaded stud, wherein the support pipe is capable of being rotated relative to said pipe end bracket and said support pin, said adjustment end collar is secured to said support pin with said tightening member to prevent rotation of the pipe clamp relative to said adjustment end bracket.

7. The pipe clamp rotation kit for a pipe clamp of claim 6, wherein:

said L-shaped bracket includes a mounting plate and a support plate, said support plate extends upward from said mounting plate.

8. The pipe clamp rotation kit for a pipe clamp of claim 7, wherein:

said support pin extends from opposing sides of said support plate.

9. The pipe clamp rotation kit for a pipe clamp of claim 6, wherein:

a screw groove is formed in said support pin, said screw groove is sized to receive an end of said threaded stud.

10. The pipe clamp rotation kit for a pipe clamp of claim 6, wherein:

said pipe end bracket includes a pipe mounting plate and a pipe support plate, said pipe support plate extends upward from said pipe mounting plate.

11. A pipe clamp rotation kit for a pipe clamp, the pipe clamp includes a support pipe, a lead screw, a slidable clamp jaw, an adjustable clamp jaw, a screw base and a crank, the lead screw is threadably engaged with the screw base, an end of the lead screw is rotatably retained on an end of the adjustable clamp jaw, the adjustable clamp jaw is slidably retained on the support pipe, the crank rotates an opposing end of the lead screw, comprising:

an adjustment end bracket includes a L-shaped bracket and a support pin, said support pin extends from said L-shaped bracket, wherein an outer diameter of said support pin is inserted into an inner diameter of one end of the support pipe of the pipe clamp, said support pin does not rotate relative to said adjustment end bracket, said outer diameter of said support pin makes direct contact with the inner diameter of the support pipe, said L-shaped bracket is attached to a support surface;

a pipe end bracket includes a pipe hole, an opposing end of the support pipe is inserted through said pipe hole;

a pipe end bracket includes a pipe hole, an opposing end of the support pipe is inserted through said pipe hole;

a tightening member includes a threaded stud; and an adjustment end collar includes a collar base and a pair of ears, said pair of ears extend from one side of said collar base, said pair of ears are adjacent to each other, a bore is formed through said collar base for insertion of said support pin, a space between said pair of ears is sized to capture opposing sides of the lead screw of the pipe clamp, the lead screw is capable of rotating relative to said pair of ears, said collar base includes a threaded hole, said threaded hole is sized to threadably receive said threaded stud, wherein the support pipe is capable of being rotated relative to said pipe end bracket and said support pin, said adjustment end collar is secured to said support pin with said tightening member to prevent rotation of the pipe clamp relative to said adjustment end bracket.

12. The pipe clamp rotation kit for a pipe clamp of claim 11, wherein:

said L-shaped bracket includes a mounting plate and a support plate, said support plate extends upward from said mounting plate.

13. The pipe clamp rotation kit for a pipe clamp of claim 12, wherein:

said support pin extends from opposing sides of said support plate.

14. The pipe clamp rotation kit for a pipe clamp of claim 11, wherein:

a screw groove is formed in said support pin, said screw groove is sized to receive an end of said threaded stud.

15. The pipe clamp rotation kit for a pipe clamp of claim 11, wherein:

said pipe end bracket includes a pipe mounting plate and a pipe support plate, said pipe support plate extends upward from said pipe mounting plate.

16. The pipe clamp rotation kit for a pipe clamp of claim 1, wherein:

a pipe end collar is sized to receive the support pipe.

17. The pipe clamp rotation kit for a pipe clamp of claim 6, wherein:

a pipe end collar is sized to receive the support pipe.

18. The pipe clamp rotation kit for a pipe clamp of claim 11, wherein:

a pipe end collar is sized to receive the support pipe.

* * * * *